US006987219B2

(12) United States Patent
Hsieh

(10) Patent No.: US 6,987,219 B2
(45) Date of Patent: Jan. 17, 2006

(54) ANGLE ADJUSTMENT DEVICE FOR A PADDLE OF A CYMBAL STAND

(76) Inventor: Wu-Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 79 days.

(21) Appl. No.: 10/721,290

(22) Filed: Nov. 26, 2003

(65) Prior Publication Data

US 2005/0109895 A1 May 26, 2005

(51) Int. Cl.
*G10D 13/02* (2006.01)

(52) U.S. Cl. ..... 84/422.1; 84/422.3

(58) Field of Classification Search ..... 84/422.3, 84/422.2, 422.1

See application file for complete search history.

(56) References Cited

U.S. PATENT DOCUMENTS 5,044,249 A * 9/1991 Hoshino ..... 84/422.3
5,192,822 A * 3/1993 Hoshino ..... 84/422.3
5,883,321 A * 3/1999 Hsieh ..... 84/422.3

* cited by examiner

*Primary Examiner*—David Martin
*Assistant Examiner*—Jianchun Qin
(74) *Attorney, Agent, or Firm*—Troxell Law Office, PLLC

(57) ABSTRACT

An angle adjusting device for a paddle of a cymbal stand includes a pivoting block adapted to be pivotally connected between the two arms of the bracket and connected to the transmission rod, and an adjusting bracket movably connected to the pivoting block and adapted to connect to a distal end of the paddle such that the movement of the adjusting bracket changes an angle of the paddle.

12 Claims, 5 Drawing Sheets

ANGLE ADJUSTMENT DEVICE FOR A PADDLE OF A CYMBAL STAND

BACKGROUND OF THE INVENTION

1. Field of the Invention

The present invention relates to an angle adjustment device, and more particularly to an angle adjustment device for a paddle of a cymbal stand to allow the paddle to have a secure engagement with the cymbal stand during performance and for the angle adjustment of the paddle to be smooth.

2. Description of Related Art

With reference to FIG. 6, a conventional angle adjustment device (20) for a paddle (13) of a cymbal stand (10) mainly comprises a pivoting block (22) pivotally mounted between two legs of a bracket (11) of the stand (10) and two adjusting plates (32,32') interconnected to each other via a bolt (324). The first pivoting plate (32') is pivotally connected to a distal end of the pivoting block (22) and a distal end of a second pivoting plate (32) is pivotally connected to a distal end of the paddle (13). Therefore, when the paddle (13) is pressed by the performer, the linkage between the first and second pivoting plates (32,32') drives the pivoting block (22) to pivot, which drives the transmission rod (30) in connection with a cymbal (not shown) to move. When the paddle (13) angle is to be adjusted, the user loosens the bolt (324) to allow the second pivoting plate (32) to move relative to the first pivoting plate (32') so that the angle of the paddle (13) is adjusted relative to a surface of the ground so as to adapt to different performing habits of different performers.

However, the conventional angle adjusting device suffers from several disadvantages:

1. The protruding head of the bolt (324) might hinder the movement of the performer's foot especially when the performer is playing the cymbal, as well as spoiling the overall appearance of the cymbal stand (10).

2. Accidental loosening of the engagement between the first and second pivoting plates (32,32') means that the performer will have to readjust the tightness to ensure that the two pivoting plates (32,32') are securely engaged with one another.

3. During angle adjustment, the user will have to loosen the bolt (324) first and then move the second pivoting plate (32) to a desired position. Thereafter, the user will have to tighten the bolt (324) again to secure the relative position between the first pivoting plate (32') and the second pivoting plate (32), which is too troublesome.

4. Magnitude of the stepping force on the paddle (13) is not changeable despite the change of the paddle angle such that it is impossible to satisfy users of different stepping forces.

To overcome the shortcomings, the present invention tends to provide an improved angle adjustment device to mitigate the aforementioned problems.

SUMMARY OF THE INVENTION

The primary objective of the present invention is to provide an improved angle adjustment device to allow the angle adjustment to be smooth and efficient.

Another objective of the present invention is to provide an angle adjustment device to allow the torque of the pivoting block to be changed to adapt to users of different stepping forces.

Other objects, advantages and novel features of the invention will become more apparent from the following detailed description when taken in conjunction with the accompanying drawings.

DETAILED DESCRIPTION OF THE PREFERRED EMBODIMENT

Figure 1:
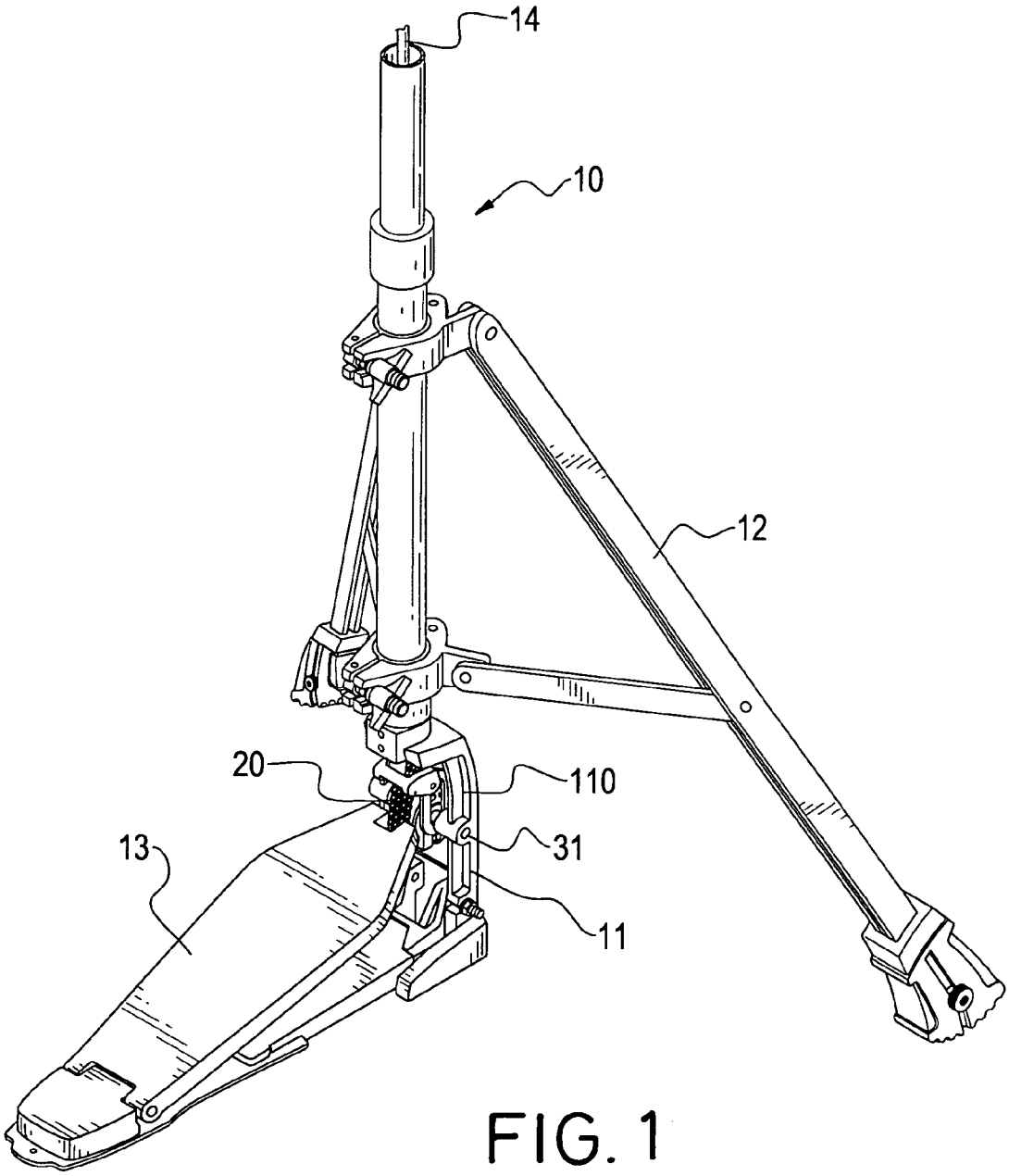
FIG. 1 is perspective view of the angle adjustment device in combination with a cymbal stand and a paddle.
Figure 2:
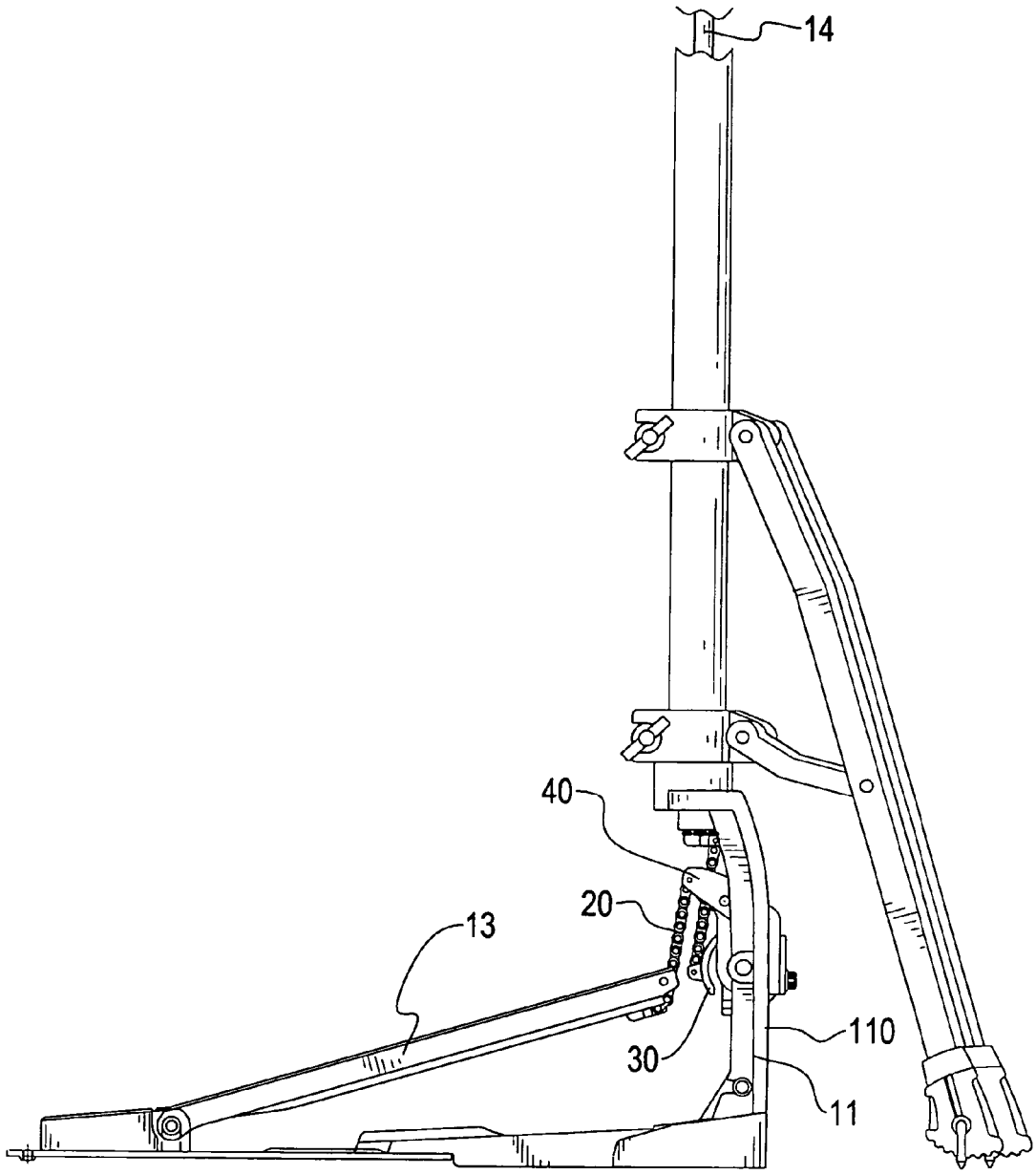
FIG. 2 is a side plan view of the angle adjustment device in FIG. 1.

With reference to FIGS. 1 and 2, it is noted that a cymbal stand (10) is equipped with a bracket (11) with two arms (110) spaced apart from each other, two legs (12) extendable relative to the bracket (11), a paddle (13) pivotal with respect to the bracket (11) and a transmission rod (14) movably mounted inside a column of the cymbal stand (10). The operation and structural relationships among the described elements are conventional and any person skilled in the art would appreciate and understand that detailed description thereof is unnecessary.

The angle adjustment device in accordance with the present invention includes a pivoting block (30) and an adjusting bracket (40).

Figure 3:
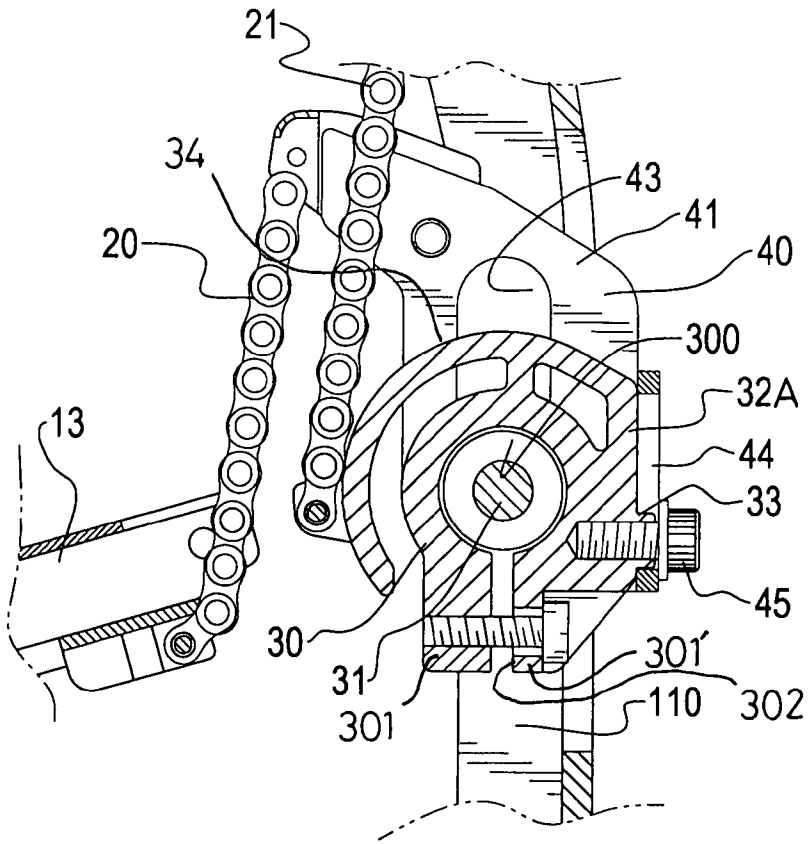
FIG. 3 is schematic side plan view with partial in section to show the mutual relationship between the pivoting block and the adjusting bracket of the angle adjustment device.

With reference to FIG. 3 and still taking FIG. 2 for reference, the pivoting block (30) is substantially cylindrical and has a centrally defined through hole (300) to receive therein a pivot (31) extending between the two arms (110), two tongues (301,301') respectively extending from an outer periphery of the pivoting block (30), a slot (302) defined between the two tongues (301,301') and in communication with the through hole (300) and an arcuate extension (34) extending from a plan face (32A) of the pivoting block (30), wherein the plan face (32A) has a stop (33) formed on and extending out from an outer side face of the plan face (32A).

Figure 4:
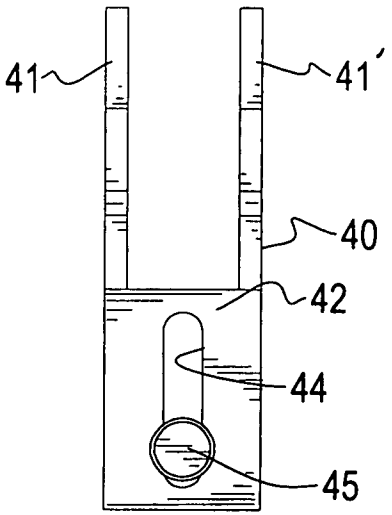
FIG. 4 is a side plan view of the adjusting bracket.

With reference to FIG. 4 and still taking FIG. 3 for reference, the adjusting bracket (40) is substantially U shaped and has two side plates (41,41') and a bottom plate (42) integrally formed with distal ends of each of the two side plates (41,41'). A channel (43) is defined in each of the side plates (41,41') to correspond to the pivot (31) and a path (44) is defined in the bottom plate (42) to correspond to the stop (33) of the pivoting block (30). A first linkage (20) is securely connected to a distal end of the paddle (13) and a distal end of each of the two side plates (41,41'). A second linkage (21) is securely connected to an outer periphery of the arcuate extension (34) and a bottom end of the transmission rod (14) (as shown in FIGS. 1 and 2).

Therefore, when the angle adjusting device of the present invention is assembled, it is noted that a securing element (preferably a screw) is applied to extend through the two tongues (301,301') such that the pivoting block (30) is able to securely engage with an outer periphery of the pivot (31).

Preferably, a bearing (not numbered) is sandwiched between the outer periphery of the pivot (31) and an inner periphery defining the through hole (300) so that the pivoting movement of the pivoting block (30) is smooth. An adjusting knob (45) is screwingly inserted into the stop (33) and abuts a side face of the bottom plate (42). Therefore, the adjusting bracket (40) is immovable relative to the pivoting block (30) after the adjusting knob (45) is extended into the stop (33) and abutted to the side face of the bottom plate (42). Thus the user is able to step on the paddle (13) to drive the transmission rod (14) (in FIG. 1) to move linearly.

Figure 5:
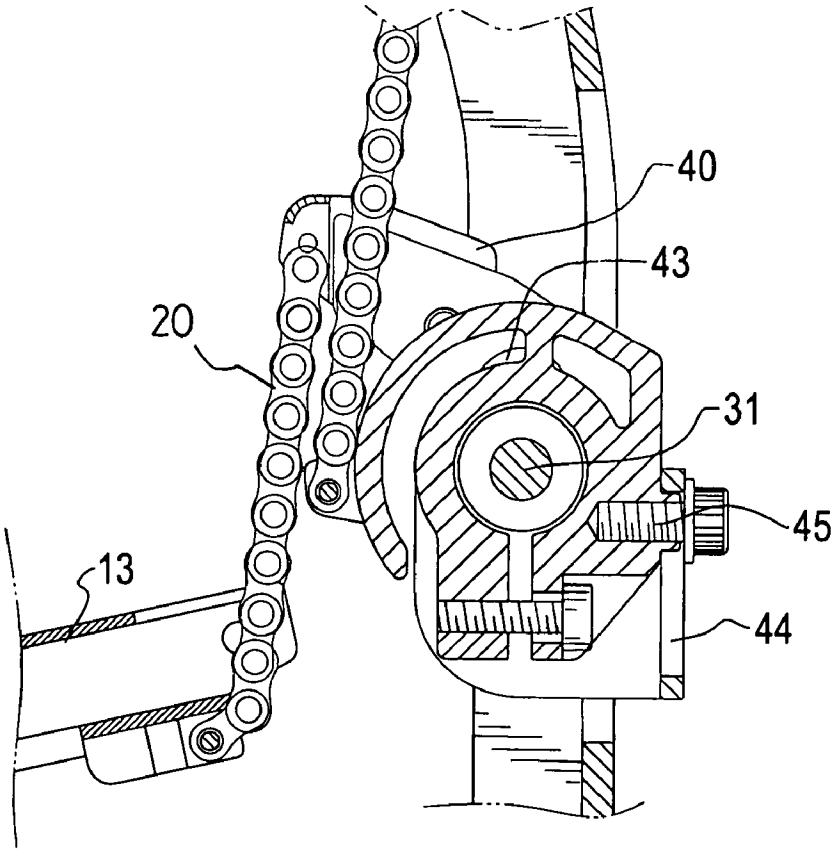
FIG. 5 is a schematic side plan view in partial section showing the mutual relationship between the adjusting bracket and the pivoting block after the adjusting bracket is moved.
Figure 6:
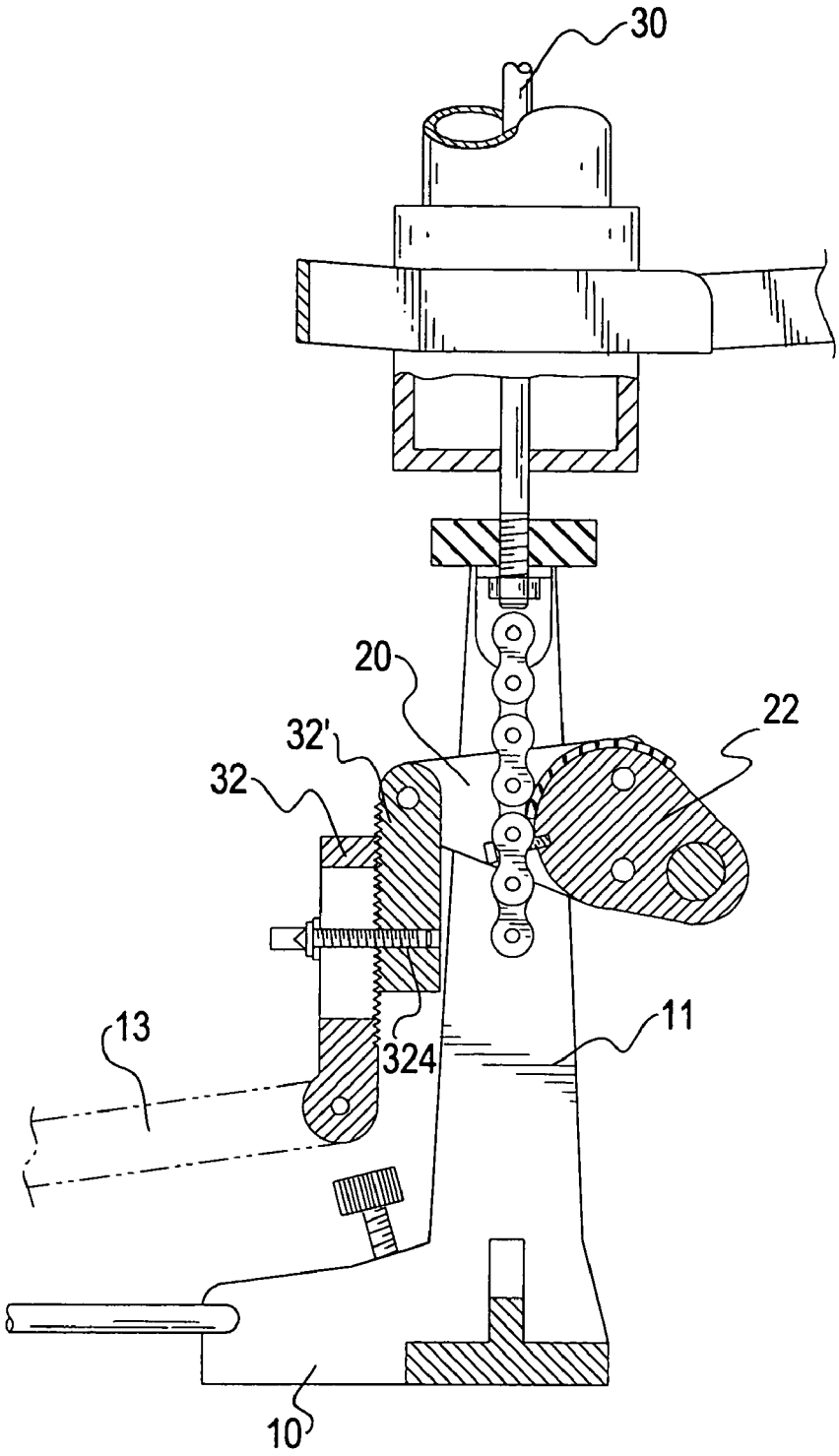
FIG. 6 PRIOR ART
FIG. 6 is a schematic side plan view showing a conventional angle adjusting device for a paddle of a cymbal stand.

When adjusting the angle of the paddle (13) is required, with reference to FIG. 5, the user is able to loosen the adjusting knob (45) and move the adjusting bracket (40) with respect to the pivoting block (30) along the path (44). After adjustment, the angle of the paddle (13) is changed and because the position of the pivoting block (30) is changed, the force on the paddle (13) to overcome the recovery force of the transmission rod (14) is accordingly changed.

Because the adjusting knob (45) is moved to the rear side of the cymbal stand (10), interference to the performer during the performance is obviated. Also, the overall appearance of the cymbal stand is not spoiled due to the rearward shift of the adjusting knob (45).

Due to the position change of the pivoting block (30), the torque and the force on the paddle to overcome the recovery force of the transmission rod is also changed.

Further, the interaction between the stop (33) and an inner face defining the path (44) provides a firm engagement between the pivoting block (30) and the adjusting bracket (40) so that the load on the adjusting knob is small and thus chances of having the adjusting knob become loose during performance of the cymbal are few.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An angle adjusting device for a paddle of a cymbal stand having a transmission rod and a bracket with two arms, the angle adjusting device comprising:

a pivoting block adapted to be pivotally connected between the two arms of the bracket and connected to the transmission rod wherein the pivoting block has a through hole centrally defined in the pivoting block for an extension of a pivot sandwiched between the two arms of the bracket so that the pivoting block is pivotally connected between the two arms of the bracket, two tongues extending from an outer periphery of the pivoting block, an arcuate extension formed outside the pivoting block and a slot defined between the two tongues to be in communication with the through hole such that the pivot is able to be securely yet pivotally received in the through hole by tightening the two tongues via a securing element; and an adjusting bracket movably connected to the pivoting block and adapted to connect to a distal end of the paddle such that the movement of the adjusting bracket changes an angle of the paddle.

2. The angle adjustment device as claimed in claim 1, wherein the adjusting bracket has two side plates each having a channel defined therein and a bottom plate integrally formed with distal ends of the two side plates and having a path defined in the bottom plate.

3. The angle adjusting device as claimed in claim 2 further having a first linkage connected to distal ends of the two side plates of the adjusting bracket and adapted to connect to a distal end of the paddle.

4. The angle adjusting device as claimed in claim 3 further having a second linkage with a first distal end securely connected to an outer periphery of the arcuate extension and a second distal end adapted to connect to a distal end of the transmission rod.

5. The angle adjusting device as claimed in claim 3 further having a second linkage with a first distal end securely connected to an outer periphery of the arcuate extension and a second distal end adapted to connect to a distal end of the transmission rod.

6. The angle adjusting device as claimed in claim 1, wherein adjusting bracket has two side plates each having a channel defined therein to align with the through hole of the pivoting block and a bottom plate integrally formed with distal ends of the two side plates and having a path defined in the bottom plate to receive therein a stop formed on the pivoting block.

7. The angle adjusting device as claimed in claim 6, wherein the stop is formed on a plan face formed on the pivoting block such that the stop is able to selectively abut two opposite inner faces of the path.

8. The angle adjusting device as claimed in claim 7 further having a first linkage connected to distal ends of the two side plates of the adjusting bracket and adapted to connect to a distal end of the paddle.

9. The angle adjusting device as claimed in claim 8 further having a second linkage with a first distal end securely connected to an outer periphery of the arcuate extension and a second distal end adapted to connect to a distal end of the transmission rod.

10. The angle adjusting device as claimed in claim 6 further having a first linkage connected to distal ends of the two side plates of the adjusting bracket and adapted to connect to a distal end of the paddle.

11. The angle adjusting device as claimed in claim 10 further having a second linkage with a first distal end securely connected to an outer periphery of the arcuate extension and a second distal end adapted to connect to a distal end of the transmission rod.

12. The angle adjusting device as claimed in claim 1 further having a first linkage securely connected to distal ends of the two side plates of the adjusting bracket and adapted to connect to a distal end of the paddle.

* * * * *